United States Patent [19]

Magnusson

[11] 4,394,566

[45] Jul. 19, 1983

[54] LADLE PREHEATER

[75] Inventor: Klas B. O. Magnusson, Hallstahammar, Sweden

[73] Assignee: Bulten-Kanthal Aktiebolag, Hallstahammar, Sweden

[21] Appl. No.: 316,128

[22] Filed: Oct. 29, 1981

Related U.S. Application Data

[63] Continuation-in-part of Ser. No. 97,673, Nov. 27, 1979.

[51] Int. Cl.[3] ..... H05B 3/06; F27B 14/00

[52] U.S. Cl. ..... 219/523; 219/421; 219/422; 219/426; 219/537; 373/128; 432/224

[58] Field of Search ..... 219/408, 388, 385, 411, 219/420, 421, 422, 423, 424, 425, 426, 427, 428, 434, 438, 441, 523, 536, 537, 10.49 R; 164/335; 432/224, 262; 53/30; 373/110, 109, 128

[56] References Cited

U.S. PATENT DOCUMENTS

| | | | |
|---|---|---|---|
| 2,780,715 | 2/1957 | Strokes | 219/523 X |
| 2,972,037 | 2/1961 | Taves | 219/523 X |
| 3,148,272 | 9/1964 | Aitken et al. | 219/537 |
| 3,373,239 | 3/1968 | Rubisch | 373/128 |
| 3,546,430 | 12/1970 | Kane | 219/523 X |
| 3,896,288 | 7/1975 | Tulkoff | 53/30 |
| 3,906,849 | 9/1975 | Williams | 219/408 X |
| 3,985,946 | 10/1976 | Werych | 373/128 |
| 4,090,054 | 5/1978 | Heine et al. | 219/523 X |

FOREIGN PATENT DOCUMENTS

| | | | |
|---|---|---|---|
| 365914 | 7/1922 | Fed. Rep. of Germany . | |
| 834433 | 2/1952 | Fed. Rep. of Germany . | |
| 1268223 | 6/1961 | France | 219/523 |
| 395214 | 1/1977 | Sweden . | |
| 170995 | 10/1921 | United Kingdom . | |
| 848192 | 9/1960 | United Kingdom . | |

*Primary Examiner*—Volodymyr Y. Mayewsky
*Attorney, Agent, or Firm*—Hill, Van Santen, Steadman, Chiara & Simpson

[57] ABSTRACT

A preheater for a casting ladle includes a stationary horizontal refractory deck having vertical apertures in which are disposed refractory plugs, each of which supports an electrical heating element that depends downwardly from the refractory deck. A lifting table is movable into registration with the set of depending electrical heating elements and is also adapted to support the casting ladle thereon and to raise it into surrounding relation with the electric heating elements that depend from the refractory deck. Individual defective heating elements can be removed and replaced during operation of other operative heating elements.

3 Claims, 3 Drawing Figures

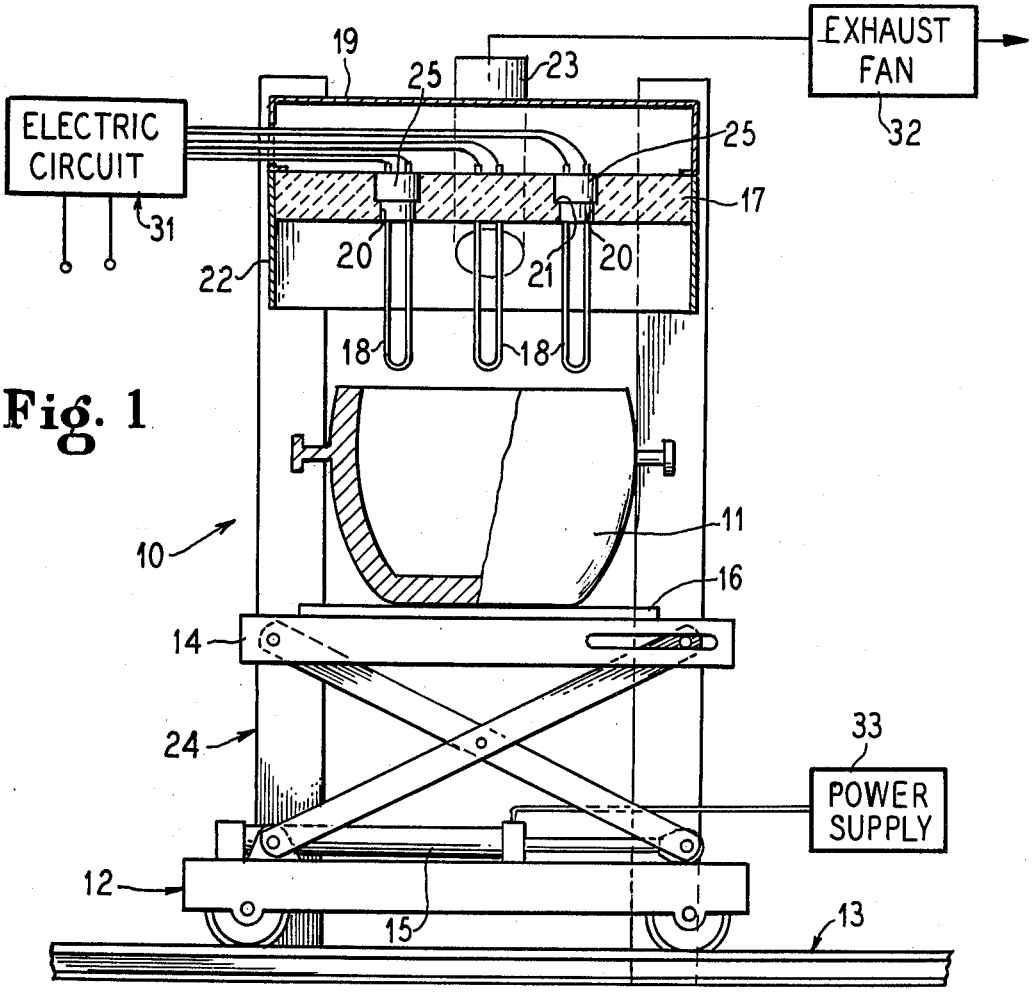
Fig. 1
Fig. 2
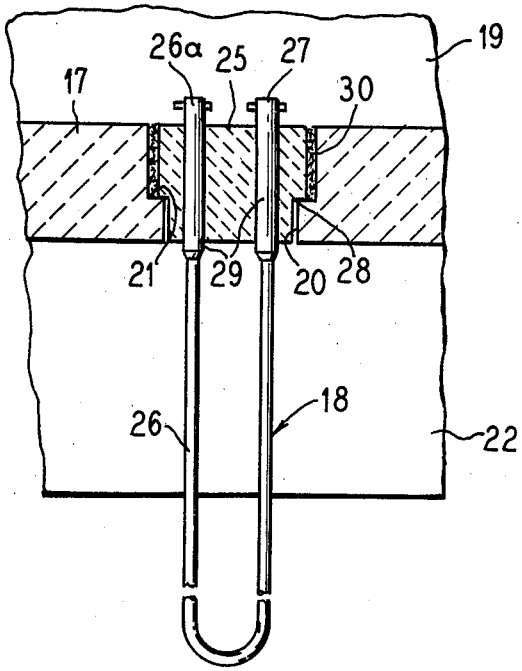
Fig. 3
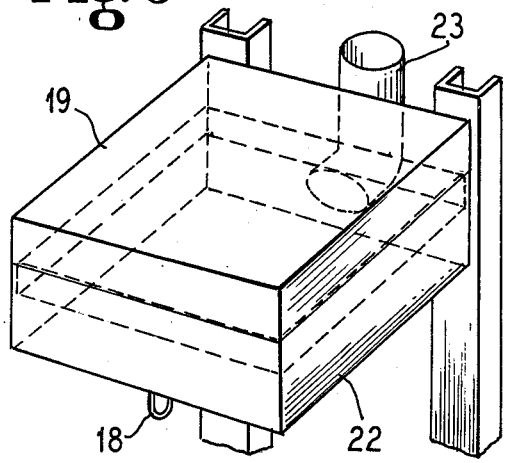

LADLE PREHEATER

RELATED APPLICATION

This application is a continuation-in-part application of my pending application, Ser. No. 97673, filed Nov. 27, 1979 for "A Ladle Heater", which pending application is hereby abandoned with the filing of the present application.

BACKGROUND OF THE INVENTION

1. Field of the Invention:

This invention pertains to apparatus by which a ladle adapted to handle molten metal may be preheated before it is placed into such service.

2. Prior Art:

Earlier ladle preheaters utilized gas or oil fired burners which gave off large quantities of unwanted gases and which were noisy in operation. In response to this problem, ladle preheaters were constructed using electrical resistance elements as sources of heat. These devices included a housing having a number of depending electrical resistance heating elements, the apparatus being placed on the upper edge of an upwardly open stationary ladle by means of a lifting device, such as a crane or hoist. In use, considerable electrical energy is needed and thus the provision of a power line necessitated that such line have sufficient flexibility and movability so as to accomodate all the movements of the preheater during its placement on and removal from the ladle. Further, the resistance elements, being rather large, are quite fragile and were frequently subjected to lateral forces during lateral movement, such as by their bumping against the ladle or any other adjacent object. It is believed that in some instances, such movable ladle preheaters required cooling water to avoid overheating of power supply lines and associated electrical components disposed remotely from the heating portions of the heating elements.

SUMMARY OF THE INVENTION

According to the present invention there is provided a fixed frame which supports a horizontal refractory deck, the deck being apertured. A set of U-shaped electrical heating elements are individually supported in a set of refractory plugs which can be installed in and removed from the apertures of the refractory deck from above. The ladle is supported on a vertically movable lifting table which is horizontally movable to a position where the elements register with the open end of the ladle. Considerably less skill is needed to move the lifting table to a position of registration so that at no time is there any possibility of the ladle or any other object striking any heating element laterally.

Accordingly, it is an object of the present invention to provide an electrically operated ladle preheater so arranged that the liklihood of lateral bumping of depending heater elements is minimized or eliminated.

Another object of the invention is to provide structure by which individual heating elements may be individually replaced and/or controlled.

A still further object of the present invention is to provide a preheater in which individual defective heating elements may be replaced during the time that the preheater is otherwise in operation.

Many other advantages, features and additional objects of the present invention will become manifest to those versed in the art upon making reference to the detailed description and the accompanying drawing in which a preferred structural embodiment incorporating the principles of the present invention is shown by way of illustrative example.

ON THE DRAWING

FIG. 1 is a diagrammatic elevational view, partly broken away and shown in cross-section, of a preheater for casting ladles, provided in accordance with the principles of the present invention;

FIG. 2 is an enlarged fragmentary cross-sectional view of a portion of FIG. 1; and FIG. 3 is a fragmentary perspective view of the upper end of the preheater shown in FIG. 1.

As Shown on the Drawings

The principles of the present invention are particularly useful when embodied in a preheater for casting ladles such as shown in FIG. 1, generally indicated by the numeral 10. A ladle 11 is supported on a lifting table 12, here formed as a cart supported on a pair of rails 13, thus enabling horizontal movement of the ladle 11. The upper portion 14 of the lifting table can be raised or lowered by means of a fluid actuator 15, therebeing a refractory upper surface 16 against which and by which the ladle 11 is directly supported.

A refractory horizontal deck 17 is fixedly secured to a frame 24 which is fixedly disposed and supported at one side of the rails 13 so that the frame 24 is adjacent to the lifting table 12 when the latter is moved into registration therewith. The deck 17 has a set of vertical apertures 20,20, each of which has an upwardly directed shoulder 21 of annular configuration.

A set of U-shaped electrical heating elements 18,18, as individually best seen in FIG. 2, are individually supported by a set of refractory plugs 25. Each individual heating element 18 has a vertical heating portion 26 that extends downwardly, projecting from beneath the plug 25, and a pair of terminal portions **26*a*,27 which extend upwardly and which project from the plug 25. Each plug 25 has a downwardly facing shoulder 28 resting on the upwardly facing shoulder 21 on the deck 17. While intermediate mounting portions 29 of each heating element 18 are secured to the respective plug 25, each plug 25 has a rather loose fit within the aperture 20 with respect to the deck 17. In this embodiment, appropriate fibers 30, for instance of asbestos, are used as a packing in the annular space lying above the shoulder 21**.

An electric circuit 31 brings power by fixed wiring to each pair of terminals **26*a*,27 or sets of such terminals so that the operator may select which elements shall be energized. The upper side of the deck 17 is enclosed by an upper hood 19 which can be removed to provide access to the connections with the terminals 26*a*,27. Thus, access can be had to a particular defective terminal 18 which can thus be removed through the aperture 20 along with its plug 25 for facile replacement and reconnection. The refractory deck 17 is also provided with a peripheral flange 22 which depends from the periphery of the refractory deck 17, When the ladle 11 is raised sufficiently so that the upper end thereof is substantially in engagement with the lower surface of the refractory deck 17, there is thus defined a space around the outer upper periphery of the ladle 11 which is enclosed by the peripheral flange, such flange functioning as a lower hood. The hood will trap any lighterthan-air gases that may emanate from the ladle 11, and these may be drawn off by an exhaust fan 32 connected to a duct 23 which communicates through the flange 22 with the interior of the lower hood. An appropriate power supply 33 having appropriate controls is connected to the actuator 15**.

In use, an empty ladle is deposited upon the support surface 16 of the lifting table 12, and then the lifting table 12 is moved on the rails 13 to a position of registration with the heating elements 18 as shown in FIG. 1. Then the power supply is actuated so as to raise the ladle 11 into surrounding relationship with the depending heating elements 18, at which time the electric circuit 31 is appropriately operated to energize a selected number of the heating elements 18 for a desired duration of time.

The heating portions 26 of the heating elements 18 may have any desired configuration, provided that they can be withdrawn through the deck apertures 20, and they preferably comprise molybdenum disilicide, $MoSi_2$, made and sold by AB Bulten-Kanthal, Hallstahammar, Sweden under the registered Trade Mark "KANTHAL SUPER". Other materials may be used such as silicon-carbide in the form of U-shaped elements or the electrical equivalent thereof.

At least 6, and preferably 10–20, of the resistance elements 18 are provided. With the present arrangement, no cooling of the power supply terminals is necessary. The electrical interconnections preferably are so made that magnetically neutral groups are formed. Illustrations of such groupings are contained in my Swedish Pat. No. 395,214 issued Aug. 1, 1977.

The elements 18 are long and slender, are brittle, and have low impact strength, especially when cool. During operation, at least the terminal portion is comparatively cool and thus it also is brittle during operation of the device. Therefore, especially during servicing and also during the time that engagement is being made with the ladle or disengagement is being effected, it is essential that the ladle heater remains stationary, thus preventing any possible unwanted lateral engagement between the heating portions of the elements 18 and any adjacent object.

Although various minor modifications might be suggested by those versed in the art, it should be understood that I wish to embody within the scope of the patent warrented hereon, all such embodiments as reasonably and properly come within the scope of my contribution to the art.

I claim as my invention:

1. A preheater for a casting ladle, comprising (a) a lifting table having an upper surface adapted to support the ladle, and an actuator for adjusting the vertical position of said upper surface;

(b) a fixed frame disposed adjacent to said table;

(c) a horizontal refractory deck fixedly secured to said fixed frame in overhanging relation to said upper surface of said lifting table;

(d) a set of U-shaped electrical heating elements composed essentially of molybdenum disilicide, each of said heating elements being supported on said deck individually, and each having a vertical heating portion extending downwardly from said deck, and a pair of terminal portions extending upwardly from said deck;

(e) a set of refractory plugs for said set of heating elements, each said plug supporting one of said elements with said portions thereof projecting therefrom, each of said plugs being disposed in a vertical aperture in said deck, and being insertable and removable from above said deck;

(f) at least one of said plugs having a downwardly facing peripheral shoulder supported on an upwardly facing shoulder within the corresponding deck aperture;

(g) an electrical circuit connected to said terminal portions; and (h) a power supply connected to said actuator; whereby the ladle, supported on said upper surface beneath said deck may be raised to receive the vertical heating portions of said set of heating elements and be internally heated thereby.

2. A preheater according to claim 1, further including an upper hood disposed at the upper surface of said deck and enclosing the terminal portions of said heating elements collectively.

3. A preheater according to claim 1, said deck having a peripheral flange depending therefrom forming a lower hood for surrounding the upper end of the ladle in spaced relation thereto, said lower hood being adapted to be connected to an exhaust fan.

* * * * *